US006131402A

United States Patent [19]

Mills, Jr. et al.

[11] Patent Number: 6,131,402

[45] Date of Patent: Oct. 17, 2000

[54] APPARATUS AND METHOD OF OPERATING A HEAT PUMP TO IMPROVE HEATING SUPPLY AIR TEMPERATURE

[75] Inventors: Eugene L. Mills, Jr., Plainfield; Rajendra K. Shah, Indianapolis, both of Ind.

[73] Assignee: Carrier Corporation, Farmington, Conn.

[21] Appl. No.: 09/089,978

[22] Filed: Jun. 3, 1998

[51] Int. Cl.[7] ..... F25D 17/00

[52] U.S. Cl. ..... 62/179; 62/181; 62/183; 62/186

[58] Field of Search ..... 62/186, 160, 183, 62/181, 179

[56] References Cited

U.S. PATENT DOCUMENTS

| | | | |
|---|---|---|---|
| 2,293,482 | 8/1942 | Ambrose | 62/6 |
| 2,884,764 | 5/1959 | Siggelin | 62/81 |
| 3,276,220 | 10/1966 | Miner | 62/180 |
| 3,500,655 | 3/1970 | Lyons | 62/183 |
| 4,141,408 | 2/1979 | Garnett . | |
| 4,364,237 | 12/1982 | Cooper et al. | 62/160 |
| 4,852,360 | 8/1989 | Harshbarger, Jr. et al. | 62/126 |
| 4,978,896 | 12/1990 | Shah . | |
| 5,492,273 | 2/1996 | Shah . | |
| 5,867,997 | 2/1999 | Lee | 62/180 |

*Primary Examiner*—Henry Bennett
*Assistant Examiner*—Marc Norman
*Attorney, Agent, or Firm*—Wall Marjama Bilinski & Burr

[57] ABSTRACT

An apparatus and method for a heat pump operating in the heating mode controls the condenser air flow rate and the condenser exiting air temperature depending in a first embodiment on the evaporator ambient temperature, and in a second embodiment, the evaporator air temperature and alternatively the condenser air flow rate or the condenser exiting air temperature, to alleviate a cold blow condition. The apparatus and method operate by sensing the evaporator ambient temperature with a sensor positioned proximate to the evaporator, and when that temperature is below a threshold value indicating a cold blow situation, determining by circuit means a modified condenser air flow rate to achieve at the same time a slower air flow and a higher air temperature, so that the cold blow condition is terminated or at least alleviated. The apparatus and method alternatively command the blower to achieve a determined condenser air flow, or to achieve a determined blower speed depending upon motor type, that results in a targeted condenser air flow or a targeted condenser exiting air temperature.

7 Claims, 3 Drawing Sheets

APPARATUS AND METHOD OF OPERATING A HEAT PUMP TO IMPROVE HEATING SUPPLY AIR TEMPERATURE

BACKGROUND AND SUMMARY OF THE INVENTION

This invention relates generally to heat pump systems and more particularly to an apparatus and method for raising both the heating mode condenser air flow temperature and at the same time decreasing the heating mode condenser duct air flow rate, for a given sensed evaporator ambient air temperature.

Heat pumps are refrigeration systems used in both heating and cooling. Heat pump systems use a refrigerant to carry thermal energy between a relatively hotter side of a circulation loop, where compression of the refrigerant by a compressor raises the temperature of the refrigerant, to a relatively cooler side of the loop at which the refrigerant is allowed to expand, causing a temperature drop. Thermal energy is added to the refrigerant on one side of the loop and extracted from the refrigerant on the other side, due to the temperature differences between the refrigerant and the indoor and outdoor air, respectively, to make use of the outdoor air as a thermal energy source.

Heat pumps are bi-directional, in that suitable valve and control arrangements selectively direct the refrigerant through indoor and outdoor heat exchangers so that the indoor heat exchanger is on the hot side of the refrigerant circulation loop for heating and on the cool side of the refrigerant circulation loop for cooling. A circulation fan passes indoor air over the indoor heat exchanger and through ducts leading to the indoor space. Return ducts commonly extract air from the indoor space and bring the air back to the indoor heat exchanger. A fan likewise passes ambient air over the outdoor heat exchanger, and releases heat into the open air, or extracts available heat therefrom.

These types of heat pump systems can operate only if there is an adequate temperature difference between the refrigerant and the air at the respective heat exchanger so as to maintain a transfer of thermal energy. As the heating mode evaporator ambient air (or outdoor air) temperature decreases, the refrigerant temperature entering the condenser consequently decreases, and the air temperature heated by the condenser and exiting the condenser consequently decreases. At outside air temperatures as high as 50° F., it is typical that the condenser exiting air temperature has already decreased to below 98° F., and will decrease further as the outdoor air temperature declines. Persons exposed to an exiting air flow draft below 98° F. experience a feeling of discomfort that is heightened further when the exiting air temperature drops. The phenomenon of this uncomfortable feeling is commonly referred to as "cold blow". During a cold blow condition, the more rapid the flow rate of the exiting air, the greater the feeling of cold blow discomfort.

It is conventional practice to design a heat pump system primarily for use as a cooling mode apparatus, and consequently optimize heat pump system characteristics for their cooling mode operation characteristics and not their heating mode operation. Specifically, prior art heat pump system indoor heat exchanger fan speeds are optimized for their performance as cooling mode evaporator fans, and the heating performance of the cooling mode evaporator fan speeds is conventionally considered acceptable for the heating mode on the basis of system design economy and capacity performance.

The optimization of heating mode condenser fan speeds for their use as cooling mode evaporator fans results in fans that are generally of a fixed speed that create a greater air flow than is necessary for the heating mode operation. Prior art heat pump system control is accomplished by using a thermostat that cycles the entire system (compressor and fans) on and off in response to a demand for heating, thereby maintaining the temperature inside an enclosure at a desired level. In particular, during operation at relatively cool outdoor temperatures, these fan speeds result in a higher speed enclosure air circulation, and an air cooler than would be obtained with lower condenser fan speed operation, alternatively exacerbating the affect of cold blow, or creating a cold blow situation. The heating capacity supplied by the heat pump to heat the space is sufficient, but it is delivered at a relatively low temperature and at an air velocity which feels drafty. The problem worsens as the outdoor temperature falls and supplementary heat is not required (because the system is above the thermal balance point) to meet capacity needs. The heat pump system capacity decreases and, with constant airflow, the supply air temperature is correspondingly lower, increasing the cold blow affect of the delivered air.

It is also conventional practice to design a heat pump system indoor heat exchanger fan speed to provide at least the desired air flow for a range of indoor heat exchanger duct air drag characteristics, so that at duct air drags less than the maximum designed for duct air drag, the furnished air flow is generally greater than necessary to provide the desired heat exchange.

Accordingly, there is a long-felt need when the outdoor air temperature is low enough to cause a cold blow condition, to raise the temperature of the condenser exiting air, and/or to lower the flow rate of the condenser exiting air.

The conventional means for relieving a cold blow situation is to include a supplementary heater that generates electrical resistive heat disposed in the exiting air path of the heat pump system. U.S. Pat. No. 4,141,408 discloses such a conventional means for increasing the temperature of the exiting air. This particular patent proposes to use sensors positioned on an indoor coil to measure the temperature of the air leaving the coil. The heating elements are turned on and off in response to the temperatures sensed by the sensors. The inclusion of supplementary heaters to a heat pump system add otherwise unnecessary expense and complication to the heat pump system. Furthermore, during the period of supplementary heat dissipation during a cold blow situation, the supplementary heaters significantly increase the expense and consumption of energy to the operational costs of the heat pump system.

It is therefore an object of the present invention to overcome the problems of the prior art described above by providing a system which controls of the indoor air mover in a manner to provide the optimum comfort performance that can be achieved from a heat pump while maintaining reliable compressor operation.

A further object of this invention is to eliminate the feeling of cold blow experienced in the use of heat pumps for residential heating at mid to low outdoor temperatures where the heat pump is satisfying the structure load required without supplementary electric heater use.

Another object of the invention to provide a control method for a heat pump system which will adjust the indoor airflow during periods where auxiliary heat is not required to meet the space load, but where the heat pump capacity is too low to deliver air at a comfortable temperature.

It is a further object of this invention to provide such a control by the use of an outdoor temperature sensor input for direct measurement of the outdoor temperature, and a control algorithm using the measured temperature information to modify the operation of the indoor blower to improve the temperature and velocity of the conditioned air delivered to the space resulting in improved occupant comfort.

Another object of this invention to provide a heat pump system which will respond to thermostat signals in a manner which will result in the improved occupant comfort.

Briefly stated, the objectives of the present invention have been attained by a heat pump operating in the heating mode that controls the condenser air flow rate and the condenser exiting air temperature, depending in a first embodiment upon the evaporator ambient temperature, and in a second embodiment, upon the evaporator air temperature and alternatively the condenser air flow rate or the condenser exiting air temperature. The apparatus and method operate by sensing the evaporator ambient temperature with a sensor positioned proximate to the evaporator, and when that ambient temperature is below a threshold value thus indicating a cold blow situation, determining by circuit means a modified condenser air flow rate to achieve both a slower air flow, and a higher air temperature, terminating the cold blow condition. The apparatus and method alternatively command the blower to achieve a determined condenser air flow, or a determined speed depending upon motor type, that results in a targeted condenser air flow or a targeted condenser exiting air temperature.

According to an apparatus embodiment of the present invention, a heat pump operating in the heating mode having an indoor air exchanger, the condenser, includes a means for moving the supply air over the condenser (generally at least one blower), and a thermostat means that has both a sensor means for determining the outdoor air temperature (more broadly the evaporator ambient temperature) and a means for regulating the flow rate (volume of air per unit of time) of the supply air over the condenser in response to the outdoor air temperature, so that a non-cold blow situation is ensured.

A method embodiment of the present invention includes a sensing step of sensing the evaporator ambient temperature, a determining step of determining at a given evaporator ambient temperature a blower supply air flow characteristic that is consistent with a non-cold blow supply air temperature or a reduced supply air flow rate flow rate that alleviates a cold blow condition, and a transmitting step of transmitting the determined blower supply air flow characteristic to the blower. The term "blower supply air flow characteristic" refers to the characteristic that is used to control the blower motor of the variable speed blower, including alternatively a motor speed command consistent with motor type, or a targeted supply air flow rateb or blower motors that adjust their speed according to a targeted flow rate.

The above, and other objects, features and advantages of the present invention will become apparent from the following description read in conjunction with the accompanying drawings, in which like reference numerals designate the same elements.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

It is conventional practice to design a heat pump indoor heat exchanger blower speed that is both sized for operation at a speed dictated by cooling mode requirements and dictated by higher than typically encountered air duct drag, both resulting in a greater blower speed than necessary to achieve efficient condenser heat exchange. Moreover, the typical heat pump heating mode operation in both cold blow and other conditions easily accommodates the warmer refrigerant temperatures that may result from a slower air flow across the condenser heat exchanger, without exceeding the refrigerant temperature and pressure limitations.

Prior art heat pump systems do not have an indoor heat exchanger blower speed that is sized for a cold blow outdoor air temperature, and do not induce a lower condenser air flow during cold blow conditions, although a lower air flow is both adequately efficient and generally available within the headroom of safe operating limitations. Prior art indoor heat exchanger blower speed can be lowered during cold blow conditions to provide a more comfortable lower and warmer air flow effectively solving the cold blow problem, while at the same time providing an efficient heat exchange at the condenser and supplying heat to the enclosure being heated.

The present invention provides a method and an apparatus that monitors the outdoor air temperature and when it is at a temperature cold enough to induce cold blow, reduces the heating mode condenser blower speed to provide a less drafty air flow at a higher temperature, and that includes a temperature high enough to end the cold blow condition.

Figure 1:
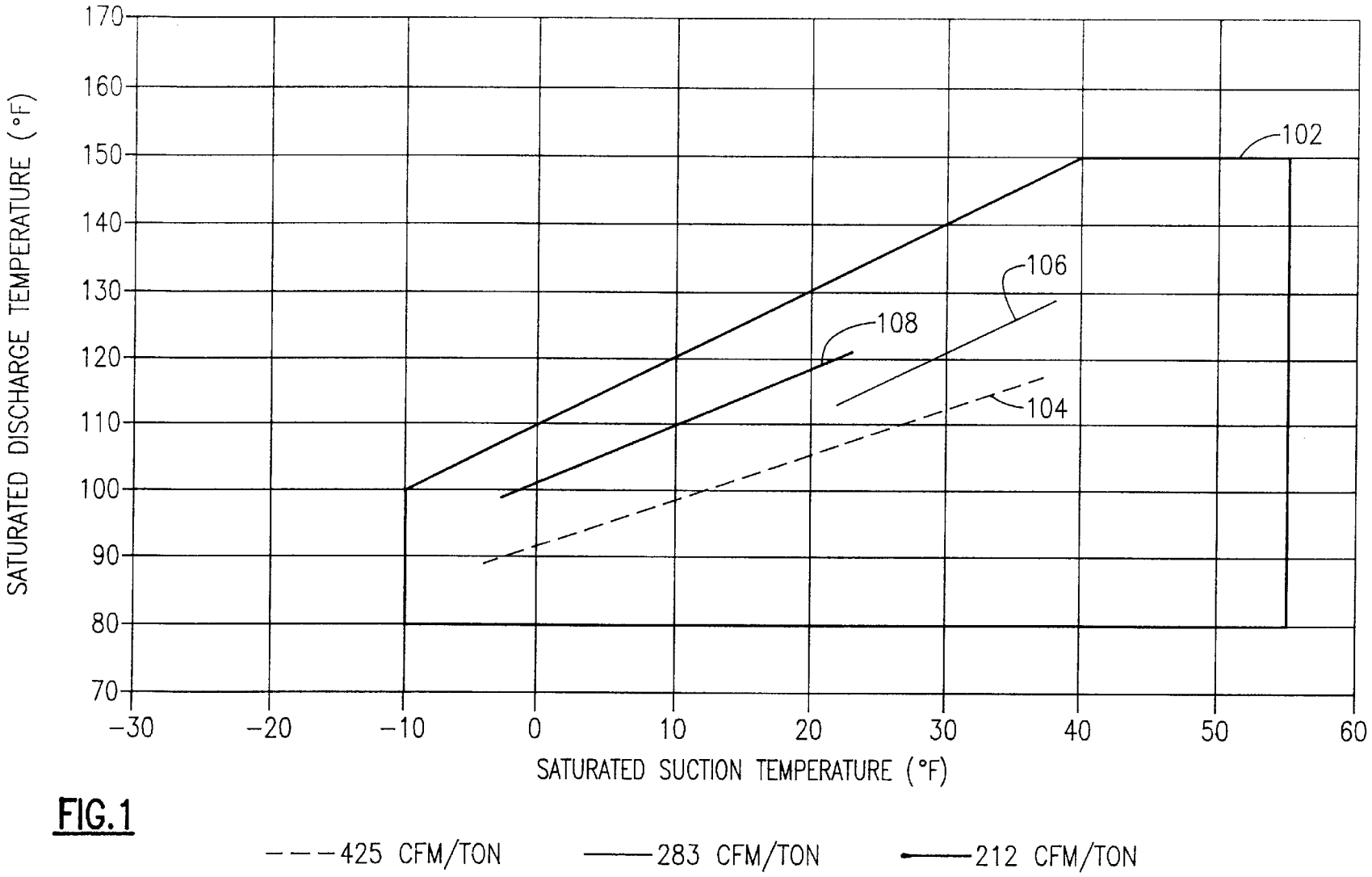
FIG. 1 portrays a heat pump compressor operating curve that plots a saturated discharge temperature versus a saturated suction temperature for a given refrigerant and heating mode condenser air flow rate.

Referring to FIG. 1, a typical heat pump compressor operating curve plots an envelope 102 of allowable compressor saturated suction temperature along the x-axis against allowable compressor saturated discharge temperature along the y-axis, where discharge temperature refers to the temperature of a saturated refrigerant at the high pressure side of a compressor, and suction temperature refers to the temperature of a saturated refrigerant at the low pressure side of a compressor. The envelope 102 portrays, for a typical refrigerant and compressor, the limits of the saturated suction and discharge temperatures necessary to properly maintain a gaseous refrigerant in the compressor, and consequently to operate the compressor under safe operating limitations.

Plotted within the envelope 102 is a typical prior art heat pump refrigerant curve relating suction temperature to discharge temperature for a typical heat pump system operating in the heating mode at a typical prior art condenser blower speed, here at a speed that results in a 425 CFM/ton air flow rate 104. It is well known in the art that an increased heating mode condenser fan speed leads to a reduced, within a limit, refrigerant temperature exiting the condenser, and accordingly to both reduced refrigerant suction and discharge temperatures. At lower fan speeds, the plot of refrigerant suction to discharge temperature has both a higher discharge and a higher suction temperature for a given outdoor temperature, and the plot of refrigerant suction to discharge temperature has a higher suction temperature for each discharge temperature.

A conventional heat pump system heating mode condenser blower speed is typically sized at a speed comfortably higher than the speed threshold speed that will lead to an unacceptably too hot refrigerant temperature, both because conventional condenser blower speeds are determined by the requirements of the cooling mode evaporator air flow rates, and because blower speeds are determined for a high drag indoor duct configuration. Thus, conventional heat pump heating mode condenser blower speeds may generally be reduced without exceeding their refrigerant temperature and pressure limitations.

Plotted is a heat pump refrigerant curve for the same typical heat pump system at a lower condenser fan speed, here 283 CFM/ton 106 for a suction temperature range from 22° F. to 38° F., and a heat pump refrigerant curve for the same typical heat pump system at a still lower fan speed, here 212 CFM/ton 108, for a suction temperature range of −3° F. to 23° F. It is seen that while these lower flow rate plots raise each curve 106 and 108 along the saturated discharge temperature axis, the typical prior art heat pump has a headroom that permits lowering the heating mode condenser fan speed while operating the heat pump system at a saturated discharge temperature that is within the envelope and above the prior art curve 104, and that is within the safe operating limits of the compressor.

Figure 2:
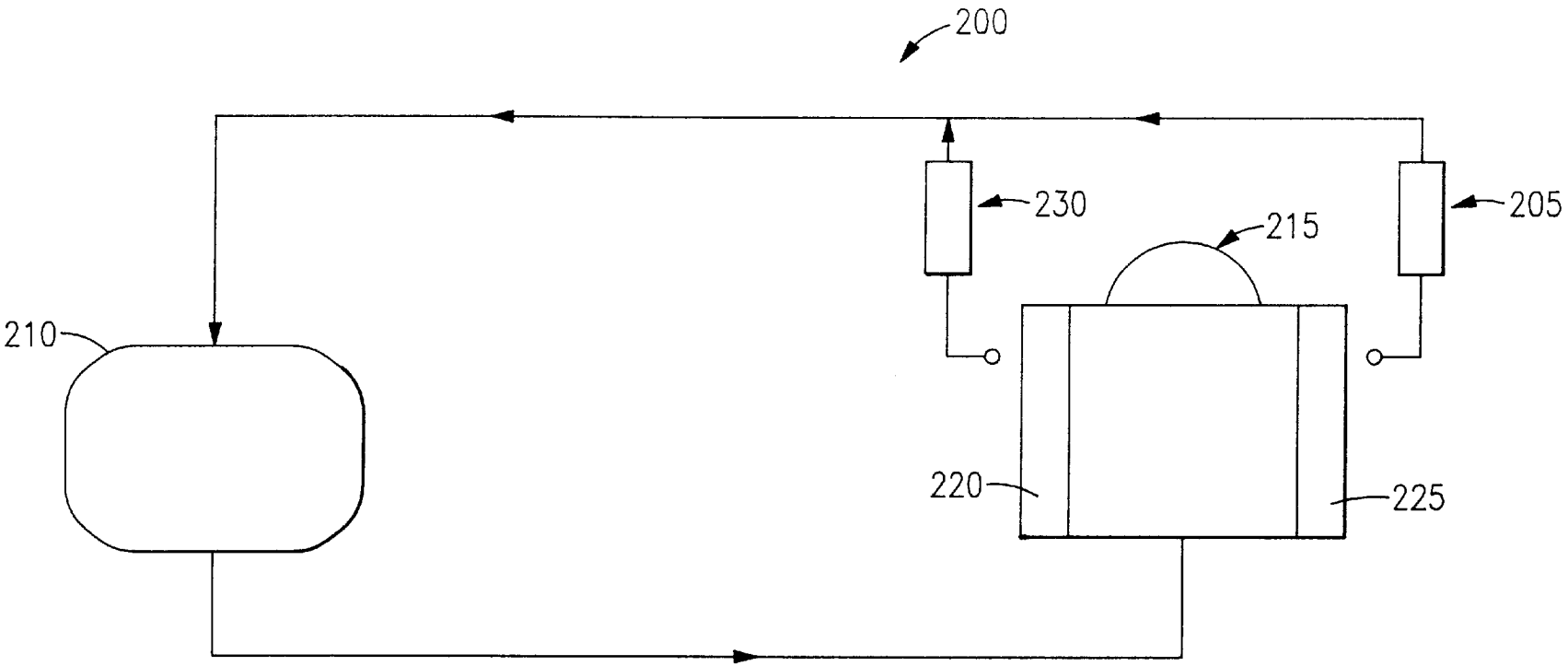
FIG. 2 portrays a schematic of the preferred embodiment heat pump system of the present invention, including an outdoor air temperature sensor, and an electronic thermostat that signals the condenser air mover to adjust air flow as a function of outdoor air temperature.

Referring to FIG. 2, the heat pump system 200 of this invention has an outdoor air temperature sensor (or more broadly an ambient temperature sensor) 205 that is positioned to sense the temperature of the ambient air at the outdoor air exchanger 225 of a heat pump 215 (which is the evaporator in the heating mode). The outdoor air temperature sensor 205 furthermore communicates that sensed outdoor air temperature to a thermostat 210, the thermostat 210 preferably including a computing device that includes a programmable computer (not shown), a computer memory device (not shown), and a program that is stored in that memory device and that is executed by the programmable computer, the thermostat commanding the indoor air exchanger blower motor to affect a prescribed exiting airflow by execution of the stored program.

The outdoor air temperature sensor 205 preferably converts the sensed temperature to a digital electrical signal that is directly compatible with the input requirements of the programmable computer, but the heat pump system of this invention may also include a conventional apparatus for converting the temperature sensor 205 electrical output signal into a signal compatible with the programmable computer.

The program includes an application program that comprises program steps that preferably in order: 1) read the outdoor sensed air temperature, 2) measure that sensed air temperature against at least one temperature threshold, 3) determine a temperature range that the sensed air temperature fits in according to the temperature threshold(s), 4) determine alternatively a determined condenser air flow or a determined condenser blower speed based on the determined temperature range of the preceding step, and 5) prepare an output command signal that is representative of the determined condenser air flow or blower speed from the preceding step.

An embodiment of the invention herein may include, rather than the computing device, a conventional circuit that senses the outdoor sensed air temperature signal, and prepares an output command signal representative of a determined condenser air temperature flow or of a blower speed, based on the outdoor sensed air temperature signal and the temperature thresholds. Such a non-computing device implementation may include a circuit comparator means, such as a digital comparator, that accepts as an input the outdoor sensed air temperature signal compared with a threshold amount, such as a digital reduction of the sensed air temperature signal and a digitized threshold. The comparator means associates output with a specific predetermined output command, such as by a specific address line to each of a non-volatile memory device address, to initiate a readout of the content of each memory address as a digital value of the commanded output signal, each memory address holding a specific command.

Figure 3:
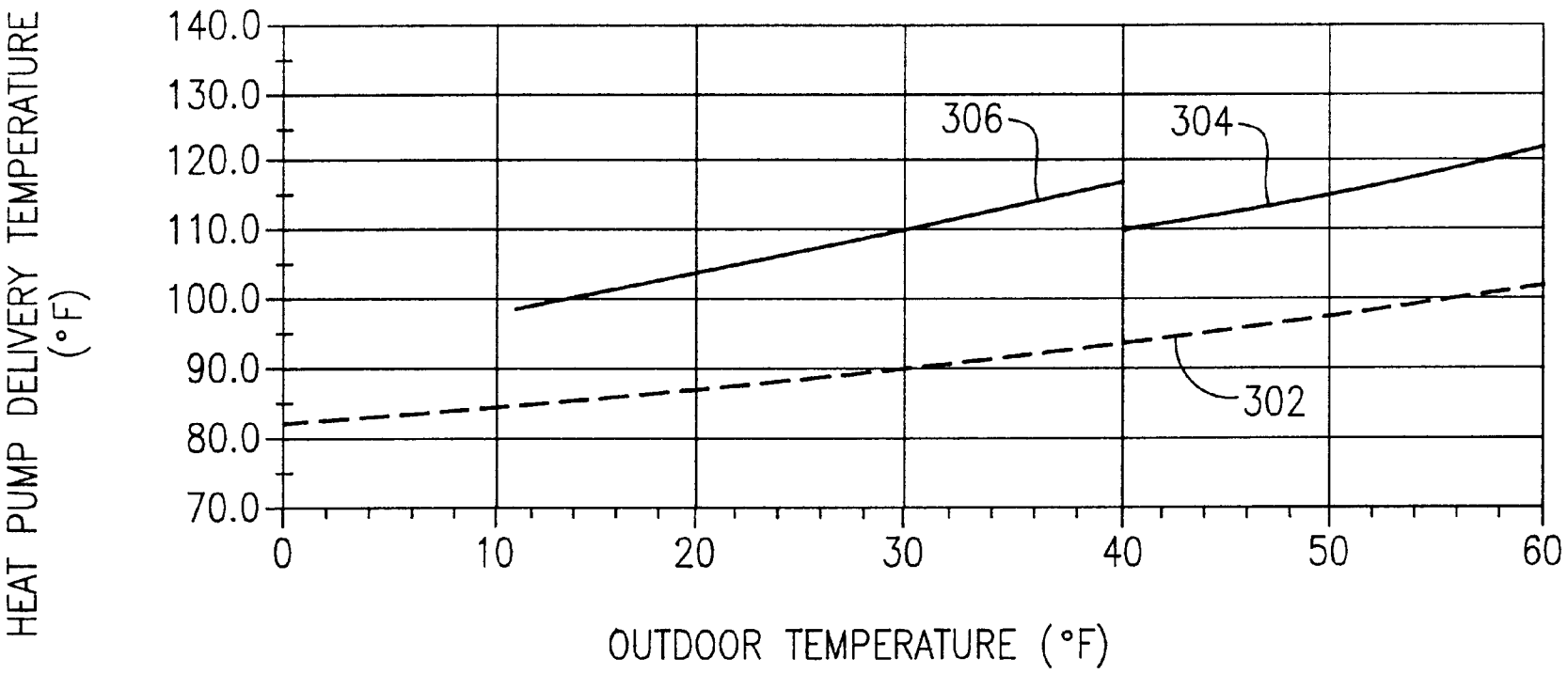
FIG. 3 portrays a heat pump heating mode operating curve that plots outdoor temperature versus condenser delivery temperature as a function of condenser air flow rate.

Referring to FIG. 3 by point of illustration of the application program logic as well as presentation of the preferred embodiment, heat pump heating mode condenser exit air temperatures are plotted against outdoor air temperatures for a CARRIER model 38YRA024300/FK4CNF001000AFAA heat pump, available from the CARRIER CORPORATION of Farmington, Conn. Curve 302 represents a plot for a condenser exit air flow rate of 425 CFM/ton over an outdoor temperature range of from 0° F. to 60° F. It is noted that the 425 CFM/ton flow rate is representative of a prior art heat pump system. Along curve 302, at an outdoor temperature of about 50° F., the condenser exit air temperature (or supply air temperature) is at 98° F., the cold blow threshold, and at all outdoor temperatures below 50° F., a cold blow situation exists. At an outdoor air temperature of 30° F., the condenser air temperature is at 90° F., and continues at lower outdoor air temperatures, the condenser air temperature continues to drop-off as the outdoor air temperature decreases.

Curve 304 represents a plot for a condenser supply air flow rate of 283 CFM/ton over an outdoor air temperature range of from 40° F. to 60° F., and curve 306 represents a plot for a condenser supply air flow rate of 212 CFM/ton at an outdoor air temperature range of from 10° F. to 40° F. It is observed that for the reduced air flow rate represented by curve 304, as contrasted with the air flow rate of the prior art curve 302, there is an approximate 20° F. condenser air exit temperature increase for each outdoor air temperature, and for the even more reduced air flow rate represented by curve 306, there is an approximate 28° F. condenser air exit temperature increase for each outdoor air temperature. Over the outdoor air temperature range above 40° F., there is no cold blow for the 283 CFM/ton condenser exit air flow rate, and over the outdoor air temperature range of from 10° F. to 40° F., there is no cold blow for the 212 CFM/ton condenser exit air flow rate.

Referring again to FIG. 2, the preferred temperature threshold(s) for the CARRIER model 38YRA024300/FK4CNF001000AFAA are 12° F. and 40° F. At above 40° F., a reduced air flow is implemented to prevent a cold blow condition, and the determined condenser air flow rate is the 283 CFM/ton air flow rate depicted in curve 304 in FIG. 3, and that results in an adequate air flow temperature of at least about 110° F. (see curve 304, FIG. 3), and an output command signal representative of a 283 CFM/ton air flow rate is prepared by the programmed computer. At 40° F. to 12° F., the determined condenser air flow rate is the 212 CFM/ton air flow rate depicted as curve 306 in FIG. 3, and that results in an adequate air flow temperature of at least about 100° F. (see curve 306, FIG. 3), and an output command signal representative of a 212 CFM/ton air flow rate is prepared by the programmed computer. At below an outdoor air temperature of about 12° F., the determined condenser air flow rate is a higher air flow than 212 CFM/ton. At least below 12° F. it is preferable to use a supplementary electric heat because the air flow temperature is approaching a cold blow temperature, and the outdoor air temperature will be approaching or below the thermal balance point of the heat pump installation.

The thermostat 210 transmits a properly and conventionally signal conditioned output signal representative of a commanded condenser air flow rate to the indoor air exchanger blower motor system 220 for proper regulation of the supply air temperature. The blower motor system and associated variable speed motor is preferably of a kind, as disclosed in U.S. Pat. No. 4,978,896, and U.S. Pat. No. 5,492,273, that maintains a preselected air flow rate regardless of the static pressure by controlling the speed of a variable speed blower motor according to the electric current though the motor. The relevant disclosures of U.S. Pat. Nos. 4,978,896, and 5,492,272, are incorporated herein by reference. Accordingly, the commanded supply air flow rate is maintained by the blower motor according to the flow rate determined by the thermostat of the present invention as described herein.

Alternatively, the thermostat of the present invention may output a blower motor digital speed command for the blower motor to regulate the supply air flow rate. That command output may include or indicate a voltage, a duty cycle for a pulse width modulated motor, a frequency, controlling switch commands for a tapped motor input, or any other output consistent with the speed adjustment means of the specific blower motor, conventionally converted to a level and form consistent with the input characteristics of the motor, wherein the command motor speed is correlated with a static targeted air flow rate according to an analytic function or a tabular look-up means.

Furthermore, the heat pump of this invention may include a supply (condenser) air sensor 230, alternatively a supply air flow rate sensor or a supply air temperature sensor, positioned to respectively sense the air flow rate or temperature, at the exit of the condenser duct. The condenser air sensor 230 signal is input into the thermostat, for a conventional closed loop determination of a motor speed based on that sensed supply air characteristic and the target air flow.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. A heat pump system of the type having an indoor air exchanger, an apparatus for controlling the supply air temperature when the heat pump is operating in a heating mode, said apparatus comprising:

a heating mode condenser variable speed blower for moving supply air over said indoor air exchanger;

thermostat means having sensor means for determining an ambient air temperature and means for converting the sensed temperature to a digital electrical signal; and a programmed control means employing an algorithm that regulates the flow rate of said supply air over said indoor air exchanger by adjusting the speed of said blower to a predetermined speed that is consistent with at least one non-cold blow condenser exiting air temperature and reduced supply air flow rate in response to said determined ambient air temperature;

whereby a non-cold blow condition is ensured.

2. The apparatus recited in claim 1, wherein said ambient air temperature includes at least one temperature range, and said programmed control means includes determining a specific air flow rate for each said range.

3. The apparatus recited in claim 1, wherein said programmed control means includes a programmable computer and a program that said programmable computer executes that performs said regulating.

4. A heat pump system of claim 1 further comprising a thermostat means having sensor means for determining the heating mode condenser supply air temperature and means for converting the sensed temperature to a digital electrical signal; and a programmed control means employing an algorithm that regulates the flow rate of said supply air over said indoor air exchanger by adjusting the speed of said blower to a predetermined speed that is consistent with at least one non-cold blow condenser exiting air temperature and reduced supply air flow rate in response to said determined ambient air temperature and/or said determined supply air temperature;

whereby a non-cold blow condition is ensured.

5. The apparatus recited in claim 4 wherein said heat pump system further comprises a supply air flow speed sensor for determining said heating mode condenser output air flow rate and for converting the sensed output air flow rate to a digital electrical signal capable of being input into a programmed control means and a programmed control means employing an algorithm to regulate the speed of said blower to a predetermined speed that is consistent with at least one non-cold blow condenser exiting air temperature and reduced supply air flow rate in response to said determined supply air flow rate and said determined air temperatures.

6. A method of operating a heat pump in the heating mode, said heat pump having a heating mode condenser variable speed blower, an evaporator ambient temperature sensor, a supply air temperature sensor for sensing said heating mode condenser output air temperature, a programmable computer and a computer program that said computer responds to, comprising:

a sensing step of sensing the evaporator ambient temperature;

an air temperature sensing step of sensing said supply air temperature;

a determining step of executing said computer program to determine a blower speed, for the supply air temperature and evaporator ambient temperature sensed, that is consistent with at least one of a non-cold blow condenser exiting air temperature and a reduced supply air flow rate for alleviating a cold blow condition; and a transmitting step of transmitting said determined blower speed to said blower;

whereby said cold blow condition is eliminated.

7. A method of operating a heat pump in the heating mode, said heat pump having a heating mode condenser variable speed blower, an evaporator ambient temperature sensor, a supply air temperature sensor for sensing said heating mode condenser output air temperature, a programmable computer and a computer program that said computer responds to, comprising:

a sensing step of sensing the evaporator ambient temperature;

an air flow speed sensing step of sensing said supply air flow rate;

a determining step of executing said computer program to determine a blower speed, for the supply air flow rate and evaporator ambient temperature sensed, that is consistent with at least one of a non-cold blow condenser exiting air temperature and a reduced supply air flow rate for alleviating a cold blow condition; and a transmitting step of transmitting said determined blower speed to said blower;

whereby said cold blow condition is eliminated.

* * * * *